US008297862B2

(12) United States Patent
Yi

(10) Patent No.: US 8,297,862 B2
(45) Date of Patent: Oct. 30, 2012

(54) IMAGE FORMING APPARATUS AND METHOD OF CONTROLLING THE SAME

(75) Inventor: Kyoung Mok Yi, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1136 days.

(21) Appl. No.: 11/972,769

(22) Filed: Jan. 11, 2008

(65) Prior Publication Data

US 2008/0170901 A1 Jul. 17, 2008

(30) Foreign Application Priority Data

Jan. 17, 2007 (KR) ..... 10-2007-0005313

(51) Int. Cl.
*B41J 11/00* (2006.01)

(52) U.S. Cl. ..... 400/582; 400/624

(58) Field of Classification Search ..... 400/582
See application file for complete search history.

(56) References Cited

U.S. PATENT DOCUMENTS 6,805,342 B2 * 10/2004 Takahara et al. ..... 271/19
7,014,378 B2 * 3/2006 Saito et al. ..... 400/582
7,862,246 B2 * 1/2011 Terada ..... 400/76
2003/0067108 A1 * 4/2003 Marra et al. ..... 271/10.01
2003/0178958 A1 * 9/2003 Akiyama ..... 318/280
2004/0195989 A1 * 10/2004 Harriman et al. ..... 318/599

* cited by examiner

*Primary Examiner* — Anthony Nguyen
(74) *Attorney, Agent, or Firm* — Stanzione & Kim, LLP

(57) ABSTRACT

An image forming apparatus and a method to control the same. The image forming apparatus variably outputs the PWM signal until the printing medium reaches the target position, accelerates the printing medium-feeding motor, and decelerates the printing medium-feeding motor in multi-stages. If the printing medium reaches the target position, the image forming apparatus decreases the PWM signal value to a predetermined value, maintains a current level, and stops the printing medium-feeding motor without rotating the printing medium-feeding motor in the reverse direction, such that the printing medium-feeding motor may instantaneously rotate in a reverse direction. As a result, the image forming apparatus can prevent the printing medium from stopping the feeding operation without reaching the printing medium to the target position due to the instantaneous reverse rotation of the printing medium-feeding motor, such that the printing medium can be maximally/correctly transferred to the target position.

12 Claims, 10 Drawing Sheets

IMAGE FORMING APPARATUS AND METHOD OF CONTROLLING THE SAME

CROSS-REFERENCE TO RELATED APPLICATIONS

This application claims the benefit of Korean Patent Application No. 2007-0005313, filed on Jan. 17, 2007 in the Korean Intellectual Property Office, the disclosure of which is incorporated herein by reference.

BACKGROUND OF THE INVENTION

1. Field of the Invention

The present general inventive concept relates to an image forming apparatus and a method of controlling the same, and more particularly, to an image forming apparatus to control a velocity of a printing medium-feeding motor capable of transferring a printing medium, and a method of controlling the same.

2. Description of the Related Art

With the increasing resolution of inkjet printers, there is a need to reduce a transfer error of a printing medium, such as paper.

When transferring the printing paper, the inkjet printer picks up the printing papers loaded in a paper cassette one by one, prints data on the printing medium, and discharges the printed printing medium. The printing medium is transferred along a transfer path by a printing medium-transferring unit receiving the power from a printing medium-feeding motor. Control of the printing medium-feeding motor is important to feed the printing medium.

When driving the printing medium-feeding motor, the deceleration of the motor may be divided into a first deceleration interval and a second deceleration interval to precisely transfer the printing medium. In some instances, the printing medium-feeding motor is accelerated during a first acceleration interval, stops acceleration during a high-constant-velocity interval, is primarily decelerated during a first deceleration interval, stops deceleration during a low-constant-velocity interval, and is finally decelerated during a second deceleration interval. Therefore, the control process of the second deceleration interval greatly affects the precision of the printing medium-feeding operation.

The velocity of the printing medium-feeding motor is controlled by a Pulse Width Modulation (PWM) signal generated from a controller. The PWM signal is increased or decreased (e.g., by increasing or decreasing the duty cycle of the PWM signal) to compensate for the difference between the velocity command and the real velocity. If the PWM drive signal to the printing medium-feeding motor creates a motor force higher than the static frictional force of the transfer apparatus, the printing medium-feeding motor begins to move, and if the PWM drive signal creates a motor force equal to or higher than the kinetic frictional force, the printing medium-feeding motor continues to move.

When the printing medium reaches a target position, the printing medium-feeding motor should stop feeding the printing medium. However, when the paper reaches the target position, a portion of the PWM signal resulting from the difference between the velocity command and the feedback of the real velocity may continue to be applied to the motor and may undesirably create a force higher than the kinetic frictional force. In this case, the printing medium-feeding motor does not stop moving, and continues to move, such that the printing medium may unavoidably escape from the target position.

A conventional art for solving the above-mentioned problem is shown in FIGS. 1A, 1B, and 1C. The conventional art performs the velocity control process from the acceleration interval to the second deceleration interval before the printing medium reaches the target position. The conventional art clears the PWM signal applied to the printing medium-feeding motor at a specific time A at which the printing medium reaches the target position. However, if the force applied to a gear of the printing medium-feeding motor due to the PWM signal disappears, as shown in FIG. 1C, the printing medium-feeding motor is allowed to rotate in a reverse direction, such that the printing medium does not reach the target position.

SUMMARY OF THE INVENTION

The general inventive concept provides an image forming apparatus to stop rotation of a printing medium-feeding motor by varying a PWM signal value transmitted to the printing medium-feeding motor when a printing medium reaches a target position, such that it can correctly feed the printing medium to the target position.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing a method of controlling an image forming apparatus, the image forming apparatus including a printing medium-feeding motor to drive a feeding unit capable of feeding a printing medium, and a controller adapted to output a Pulse Width Modulated (PWM) signal to the printing medium-feeding motor to drive the printing medium-feeding motor, the method including varying a value of the PWM signal such that the printing medium-feeding motor is decelerated after being accelerated, measuring a rotation amount of the printing medium-feeding motor, and detecting a current position of the printing medium, and upon the printing medium reaching a target position, lowering the PWM signal value to a non-zero predetermined value, such that the printing medium-feeding motor stops rotation.

The foregoing and/or other aspects and utilities of the present general inventive concept may also be achieved by providing an image forming apparatus which includes a printing medium-feeding motor for driving a feeding unit capable of feeding a printing medium, including a velocity sensor for measuring a rotation amount of the printing medium-feeding motor; a PWM driver to generate a PWM signal to drive the paper-feeding motor; and a controller for detecting a current position of the printing medium on the basis of the rotation amount of the printing medium-feeding motor, the controller varying a value of the PWM signal until the printing medium reaches a target position so that the printing medium-feeding motor is gradually decelerated after being accelerated, lowering the PWM signal value to a predetermined value after the printing medium reaches the target position so that the printing medium-feeding motor stops rotation, and maintaining the lowered PWM signal value.

The foregoing and/or other aspects and utilities of the present general inventive concept may also be achieved by providing an image forming apparatus including a motor to move a printing medium along a transfer path to a target position so that an image is formed on the printing medium in the target position, and a controller to generate a Pulse Width Modulated (PWM) signal value varying according to a position of the printing medium with respect to the target position and to generate another PWM signal value of a non-zero value to the motor to prevent the motor from rotating in a reverse direction when the printing medium is in the target position.

The foregoing and/or other aspects and utilities of the present general inventive concept may also be achieved by providing a method of forming an image in an image forming apparatus including operating a motor to move a printing medium along a transfer path to a target position so that an image is formed on the printing medium in the target position, supplying a Pulse Width Modulated (PWM) signal value to the motor which varies according to a position of the printing medium with respect to the target position, and supplying another PWM signal value of a non-zero value to the motor to prevent the motor from rotating in a reverse direction when the printing medium is in the target position.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
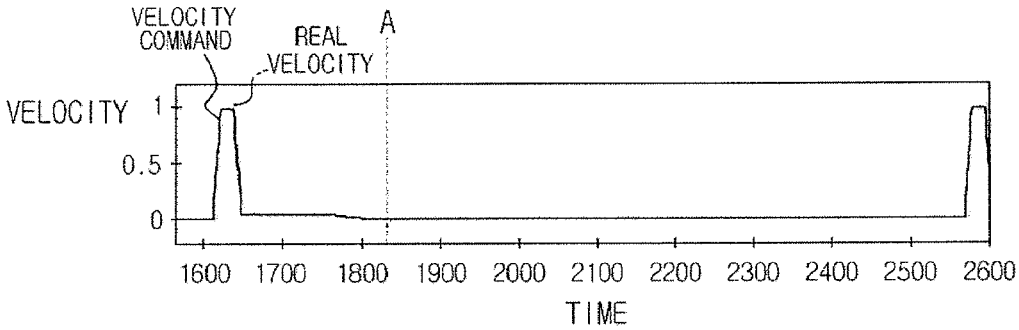
FIG 1A (CONVENTIONAL ART)
FIGS. 1A~1C are graphs illustrating a real velocity, a PWM, and an amount of motion of a paper-feeding motor contained in a conventional inkjet printer.
Figure 1B:
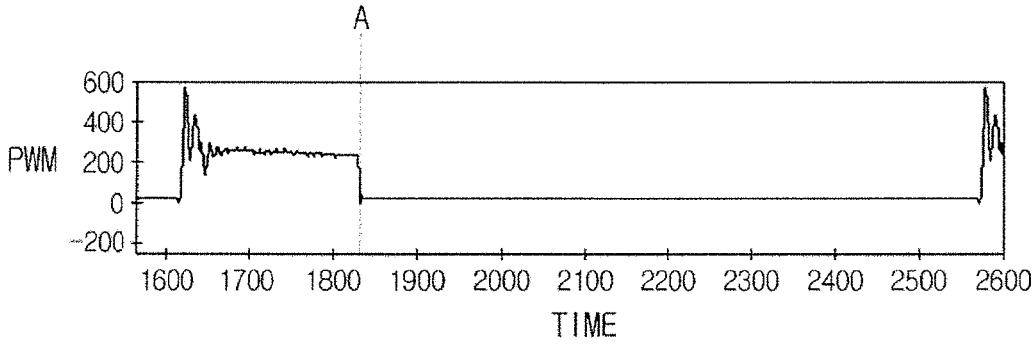
FIG. 1B (CONVENTIONAL ART)
Figure 1C:
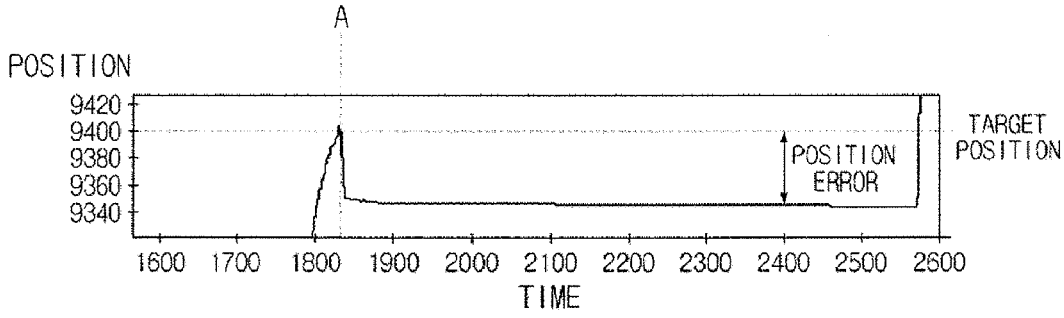
FIG. 1C (CONVENTIONAL ART)

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 2:
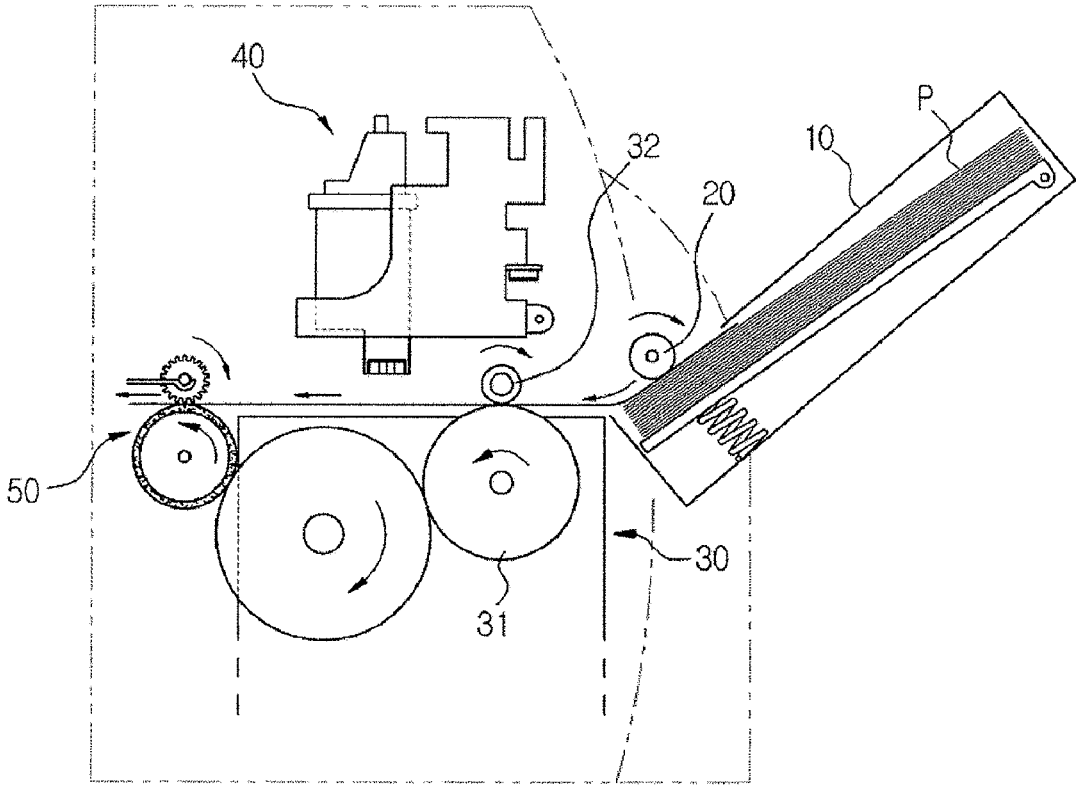
FIG. 2 is a cross-sectional view illustrating an image forming apparatus according to an embodiment of the present general inventive concept.

FIG. 2 is a block diagram illustrating an image forming apparatus such as an inkjet printer according an embodiment of the present general inventive concept. Referring to FIG. 2, the inkjet printer includes a printing medium-supply cassette 10 to be loaded with at least one printing medium P which may be paper, a pickup roller 20 which transfers the paper P loaded in the paper-supply cassette 10 to an inner part of the printer, a paper-transferring unit 30 comprising a paper transfer roller 31 and a friction roller 32 which transfers the paper P picked up by the pickup roller 20, an image forming unit 40 which forms image data on the paper P transferred by the paper-transferring unit 30, and a paper-discharge unit 50 which discharges the printed paper P to the outside.

Operations of the above-mentioned inkjet printer will hereinafter be described in detail. The paper P loaded in the paper-supply cassette 10 is picked up by the pickup roller 20, and is transferred to the paper-transferring unit 30. The paper P transferred to the paper-transferring unit 30 is transferred to the image forming unit 40 along a paper-transferring path established by the rotation of the transfer roller 31 and the friction roller 32 of the paper-transferring unit 30.

If the paper P transferred by the paper-transferring unit 30 enters the image forming unit 40, the image forming unit 40 moves a carriage equipped with an ink cartridge including a nozzle capable of jetting the ink onto the paper P to the right and left sides, and forms an image on the paper. During the image forming operation, the inkjet printer drives a paper-feeding motor, stops operation of the paper-feeding motor, and at the same time continuously transfers an unprinted part of the paper to the target position, such that the image forming operation is completed. The paper imaged by the image forming unit 40 is discharged to the outside via the paper-discharge unit 50.

Figure 3:
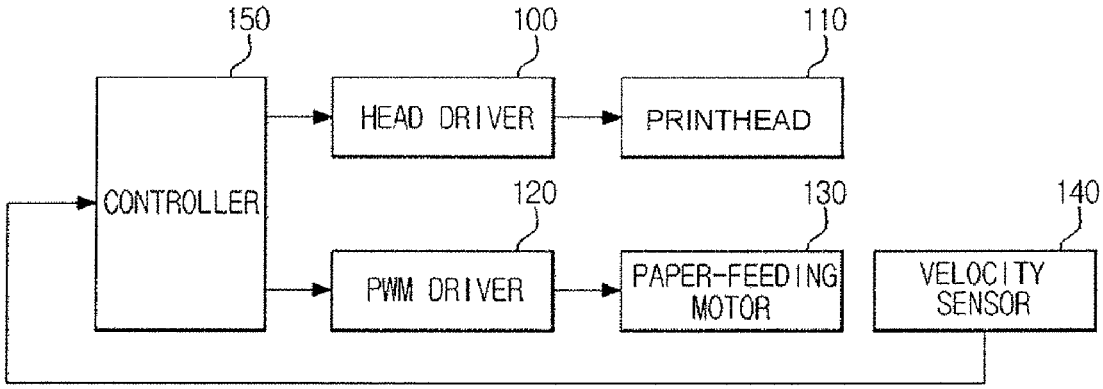
FIG. 3 is a block diagram illustrating an image forming apparatus according to an embodiment of the present general inventive concept.

FIG. 3 is a block diagram illustrating an image forming apparatus such as an inkjet printer according to an embodiment of the present general inventive concept. Referring to FIGS. 2 and 3, the inkjet printer includes a head driver 100, a PWM driver 120, a velocity sensor 140, a printhead 110, a paper-feeding motor 130, and a controller 150.

The head driver 100 drives the printhead 110 which jets ink through a nozzle of the printhead 110, to record a desired image on the paper P. The printhead 110 acts as a recording head on which several nozzles are arranged, and is driven by the head driver 100.

The PWM driver 120 outputs a PWM signal upon receiving a control signal from the controller 150, such that it drives the paper-feeding motor 130 to drive the pickup roller 20 and the paper transfer roller 31.

The velocity sensor 140 detects a rotation velocity and an amount of rotation of the paper-feeding motor 130.

Figure 4A:
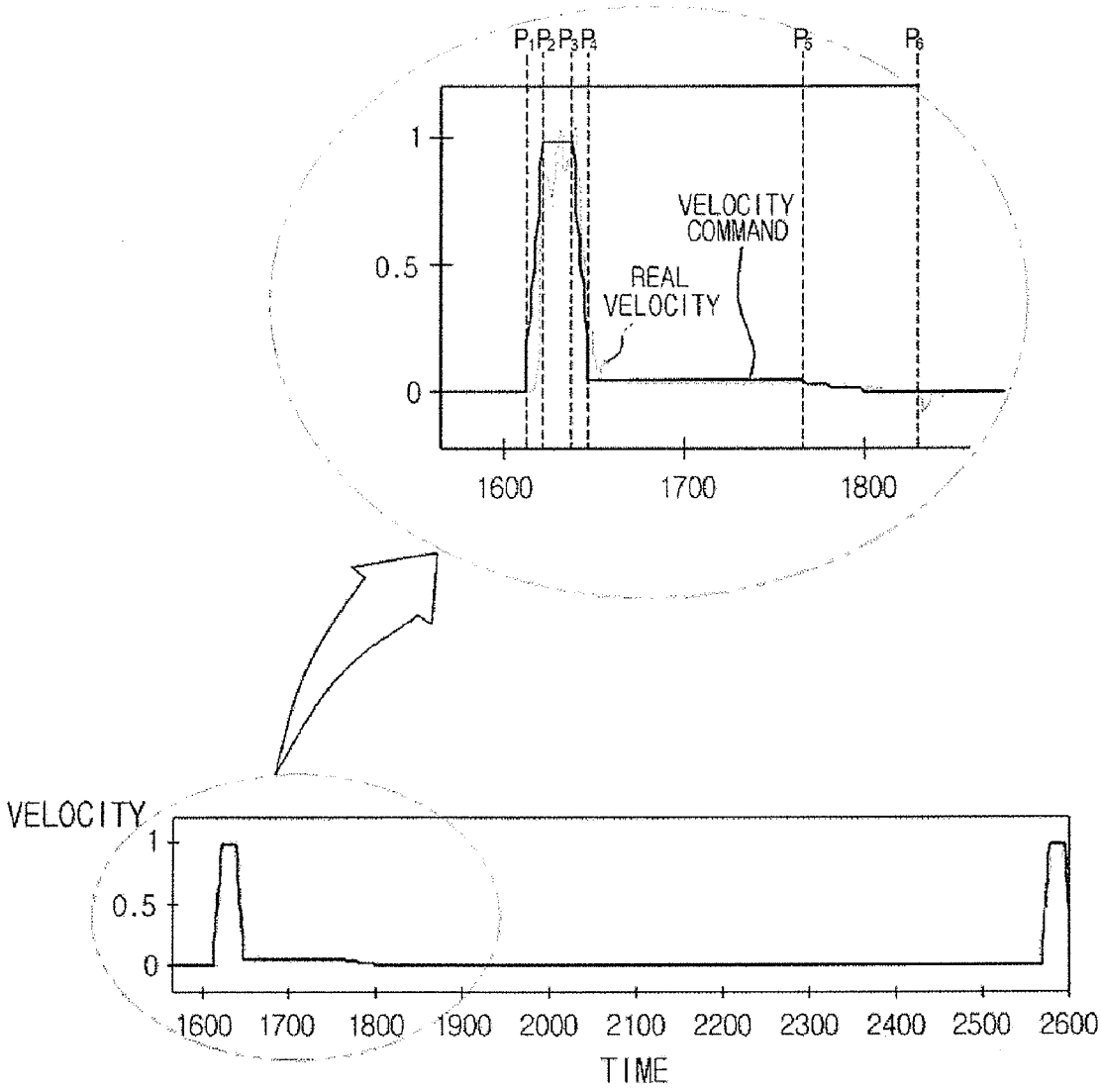
FIGS. 4A~4C are graphs illustrating a real velocity, a PWM, and an amount of motion of a paper-feeding motor shown in FIG. 3.

The controller 150 controls overall operations of the inkjet printer. Referring to FIG. 4A, the controller 150 generates a velocity profile to transfer the paper, receives the real velocity of the paper-feeding motor 130 from the velocity sensor 140, and outputs the velocity command to allow the real velocity to track the profile of the velocity command. The PWM driver 120 transmits a PWM signal value corresponding to the velocity command to the paper-feeding motor 130, and drives the paper-feeding motor 130.

Figure 4B:
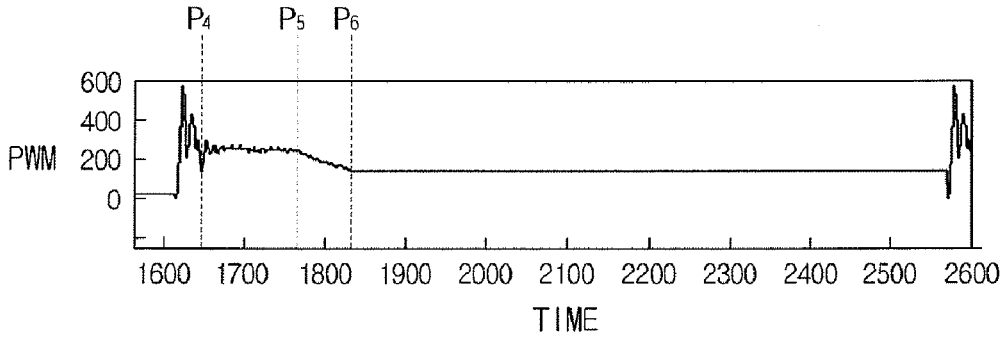
Figure 4C:
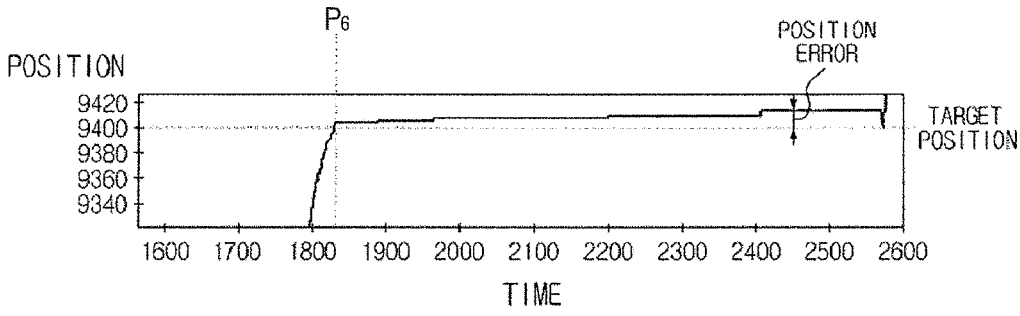

As shown in FIGS. 4A~4C, until the paper P reaches the target position, the controller 150 accelerates the motor in the acceleration interval (P1~P2), stops acceleration of the motor in the high-constant velocity interval (P2~P3), primarily decelerates the motor in the first deceleration interval (P3~P4), stops acceleration of the motor in a low-constant velocity interval (P4~P5), and secondarily decelerates the motor in the second deceleration interval (P5~P6).

Referring to FIG. 4A, the PWM signal-value lowering control process is executed after performing the secondary deceleration of the motor, such that the paper can be maximally close to the target position without stopping short of the target position. In this case, P1 is an acceleration point, P2 is a constant-velocity point, P3 is a primary deceleration point (also called a first deceleration point), P4 is a constant-velocity point, P5 is a secondary deceleration point (also called a second deceleration point), and P6 is a target-position arrival point. The P1~P5 interval is controlled on the basis of velocity, and the P5~P6 interval is controlled on the basis of position data.

Referring to FIG. 4B,the average value of the PWM signal is shown as a function of time. It will be appreciated that the average value of the PWM signal varies as the duty cycle of the PWM waveform is varied. In the following description of this example, the duty cycle of the PWM waveform and its resulting average value will be referred to as the PWM signal value. The controller 150 increases the PWM signal value to generate a first PWM signal applied to the paper-feeding motor 130 in the acceleration interval P1~P2, such that it accelerates the paper-feeding motor 130. The controller 150 fixes the PWM signal value to generate a second PWM signal applied to the paper-feeding motor 130 in the constant-velocity interval P2~P3 following the above-mentioned acceleration interval P1~P2, such that it controls the paper-feeding motor 130 at constant velocity. The controller 150 reduces the PWM signal value to generate a third PWM signal applied to the paper-feeding motor 130 in the first deceleration interval P3~P4 following the above P2~P3 interval, such that it primarily decelerates the paper-feeding motor 130. The controller 150 fixes the PWM signal value to generate a fourth PWM signal applied to the paper-feeding motor 130 in the constant-velocity interval P4~P5 following the above-mentioned first deceleration interval P3~P4, such that it controls the paper-feeding motor 130 at constant velocity. The controller 150 reduces the PWM signal value to generate a fifth PWM signal applied to the paper-feeding motor 130 in the second deceleration interval P5~P6 following the above P4~P5 interval, such that it secondarily decelerates the paper-feeding motor 130.

The controller 150 detects a current position of the paper P upon receiving the rotation amount of the paper-feeding motor 130 from the velocity sensor 140. Accordingly, the PWM signal value of the interval P5~P6 varies or is reduced according to the detected current position of the paper with respect to the target position. When a printing operation is completed, and the printing operation is not repeated and the PWM signal value is changed to zero.

Figure 5:
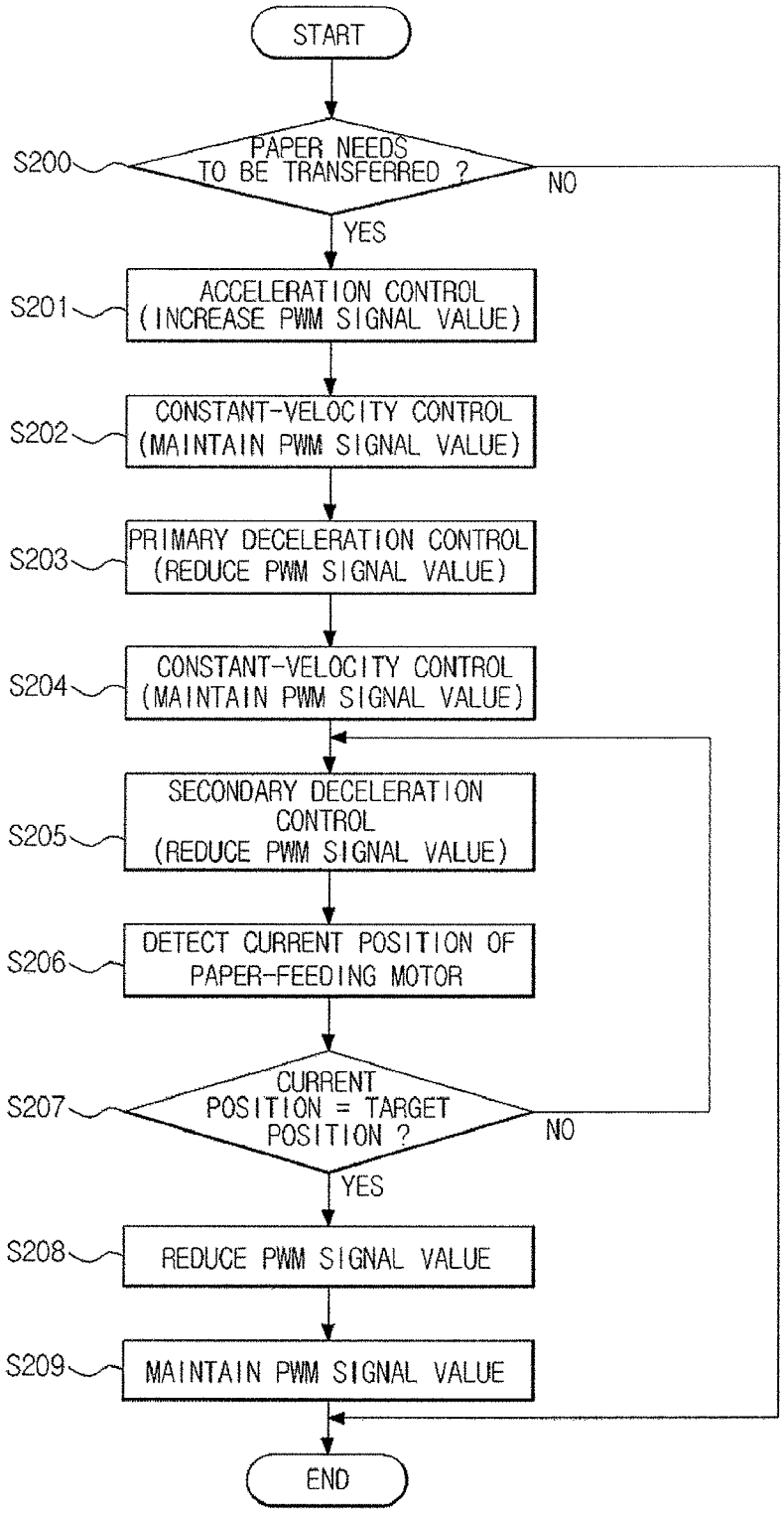
FIG. 5 is a flow chart illustrating a method of controlling an image forming apparatus according to an embodiment of the present general inventive concept.

An example operation of the embodiments of FIG. 2 and FIG. 3 will now be discussed with respect to FIG. 5. As illustrated in FIG. 5, the controller 150 determines whether the paper P must be transferred to a predetermined target position during the printing operation at Operation S200. If it is determined that the paper P must be transferred to the target position at Operation S200, the controller 150 increases the value of the PWM signal applied to the paper-feeding motor 130 via the PWM driver 120, which accelerates the paper-feeding motor 130 in the acceleration interval P1~P2 at Operation S201.

In order to rotate the paper-feeding motor 130 at constant velocity in the constant-velocity interval P2~P3, the controller 150 fixes the value of the PWM signal applied to the paper-feeding motor 130 via the PWM driver 120, such that it rotates the paper-feeding motor 130 at constant velocity in the constant-velocity interval P2~P3 at Operation S202.

Then, in order to primarily decelerate the paper-feeding motor 130 in the first deceleration interval P3~P4, the controller 150 reduces the value of the PWM signal applied to the paper-feeding motor 130 via the PWM driver 120, such that it primarily decelerates the paper-feeding motor 130 in the first deceleration interval P3~P4 at Operation S203.

Then, in order to rotate the paper-feeding motor 130 at constant velocity in the constant-velocity interval P4~P5, the controller 150 fixes the value of the PWM signal applied to the paper-feeding motor 130 via the PWM driver 120 at Operation S204, such that it rotates the paper-feeding motor 130 at constant velocity in the constant-velocity interval P4~P5 at Operation S204.

Then, in order to primarily decelerate the paper-feeding motor 130 in the second deceleration interval P5~P6, the controller 150 reduces the value of the PWM signal applied to the paper-feeding motor 130 via the PWM driver 120, such that it secondarily decelerates the paper-feeding motor 130 in the second deceleration interval P5~P6 at Operation S205.

After performing the secondary deceleration of the paper-feeding motor 130, the controller 150 detects an amount of rotation of the paper-feeding motor 130 using the velocity sensor 140, and detects a current position of the paper P on the basis of the detected rotation amount.

The controller 150 detects the current position of the paper P, compares the current position of the paper P with the target position at Operation S207, and determines whether the current position of the paper P reaches the target position. If it is determined that the current position of the paper P does not reach the target position at Operation S207, the controller 150 goes to operation S205.

Otherwise, if it is determined that the current position of the paper P reaches the target position at Operation S207, the controller 150 reduces the value of the PWM signal applied to the paper-feeding motor 130 via the PWM driver 120 in order to allow the paper P to stop at the target position, and outputs the reduced PWM signal to the paper-feeding motor 130 at Operation S208.

In this example, the PWM signal value is pre-determined by an experiment, so that the PWM signal value of the interval after the target position is higher than "0" and is less than the PWM signal value of the second deceleration interval. It is possible that the predetermined PWM signal value is indicative of the PWM signal value acquired before the paper-feeding motor 130 rotates in a reverse direction, and corresponds to the kinetic frictional force of the paper-feeding motor 130. The closer the PWM signal value is to the PWM signal value of the second deceleration interval, the higher the possibility of advancing the paper past the target position. The closer the PWM signal value is to the value "0", the higher the possibility of stopping the paper feeding action before the paper P reaches the target position.

Therefore, the PWM signal value may be set to a PWM signal value acquired before the reverse rotation of the paper-feeding motor 130, and corresponds to static frictional force, such that the controller 150 can stop the paper-feeding motor 130 without rotating in the reverse direction. Therefore, the controller 150 reduces the value of the PWM signal applied to the paper-feeding motor 130 at a specific time at which the paper P reaches the target position. And, since the PWM signal value is higher than the value "0", the controller 150 prevents the paper-feeding motor 130 from rotating in the reverse direction, while allowing the paper P to reach the target position. The PWM signal value is less than that of the second deceleration interval, such that the controller 150 can prevent the paper P from stopping the feeding operation at an undesired position exceeding the target position.

Thereafter, the controller 150 fixes the value of the PWM signal applied to the paper-feeding motor 130 via the PWM driver 120 at Operation S209.

Although the above-mentioned preferred embodiment has disclosed a method for decreasing the PWM signal value to a predetermined value at a specific point at which the paper P reaches the target position, it should be noted that the scope and spirit of the present general inventive concept is not limited to the above preferred embodiment, and is applicable to other examples as necessary.

Figure 6:
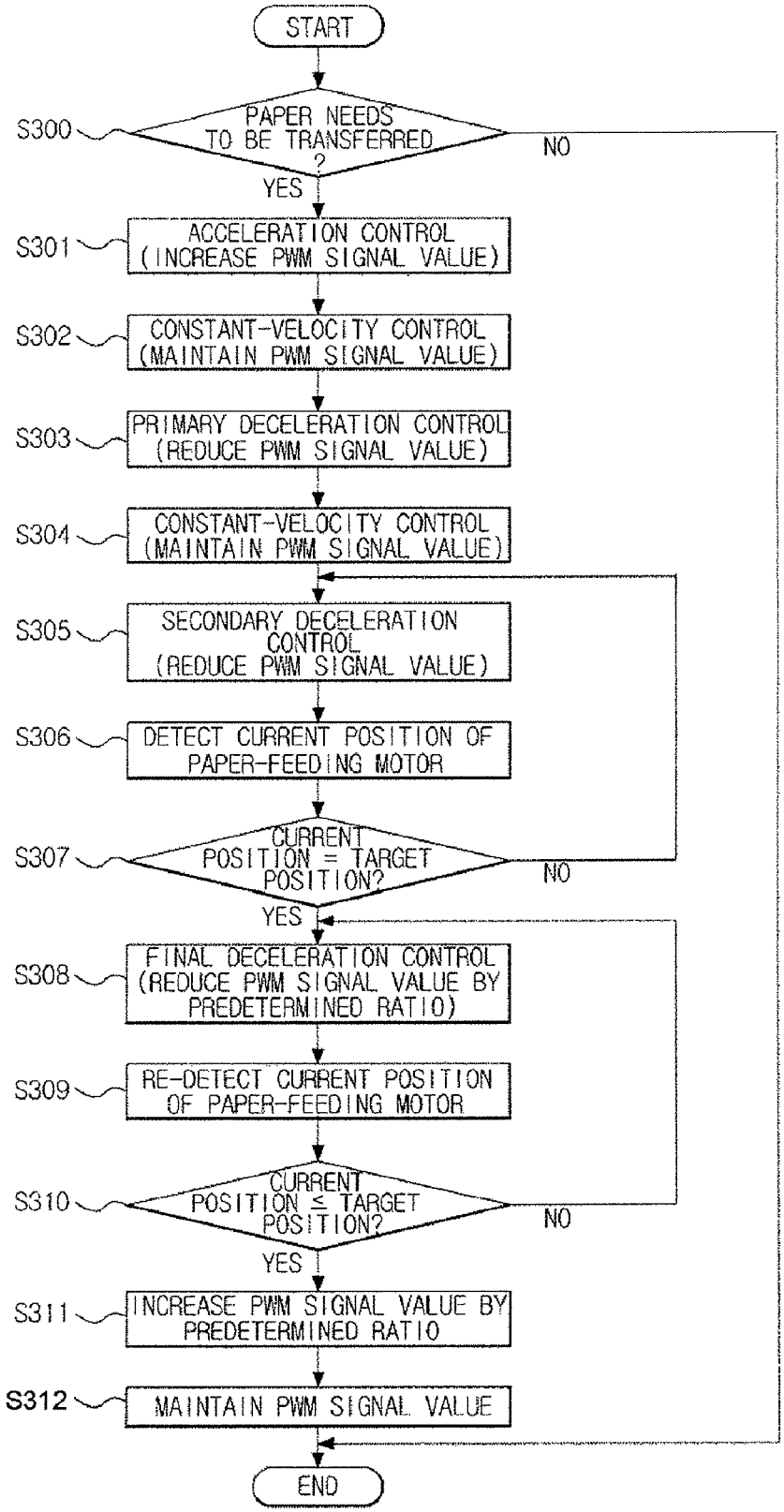
FIG. 6 is a flow chart illustrating a method of controlling an inkjet printer according to another embodiment of the present general inventive concept.

Another embodiment is shown in FIG. 6. The PWM signal value may be different according to a deviation between the kinetic frictional force of a printing medium in an image forming apparatus. This kinetic frictional force may be different between units of the image forming apparatuses (e.g., due to manufacturing tolerances) or may be different according to printing medium categories such as paper categories (e.g, paper sizes, paper thicknesses, paper materials, etc.). The kinetic frictional force may also vary between printing medium considered to be in the same category (e.g., A4 sized) due to differences in manufacturing or environmental exposure to and/or operation in different environments. In order to account for this, a method illustrated in FIG. 6 may be used. As illustrated in FIG. 6, Operations S300 to S307 correspond to Operations S200 to S207, and their description need not be repeated here. At Operation 308 the PWM signal value is decreased by a predetermined ratio, and at Operation 309, a current position of the paper P is again detected, the newly detected position of the paper P is compared with the target position, and it is determined whether the paper-feeding motor 130 has been rotated in the reverse direction. If the paper P has not been rotated in the reverse direction, the method returns to Operation S308 and the PWM signal value is again decreased by the predetermined ratio and the position of the paper P is again detected. When it is determined that the paper-feeding motor 130 has rotated in the reverse direction at operation S310, the controller 150 stops decreasing the PWM signal value, raises the PWM signal value by a predetermine ratio at Operation S311, and maintains the raised PWM signal value at Operation S312. The predetermined ratio of S311 may be the same as or different from the predetermined ratio of S308. As one example, the predetermined ratio of S308 may be 30% of the current PWM signal value and the predetermined ratio of S311 may be 50% of the difference between the initial value to which the PWM signal was reduced immediately after Operation S307 and the value of the PWM signal corresponding to when the paper-feeding motor 130 rotated in the reverse direction in Operation S310.

In more detail, the controller 150 measures the current position of the paper P for every interval after reaching the target position, and at the same time reduces the PWM signal value by a predetermined ratio. The controller 150 stops decreasing the PWM signal value when the paper-feeding motor 130 has rotated in the reverse direction and increases the PWM signal value by a predetermined ratio such that the resultant PWM signal value corresponds to the kinetic frictional force of the paper-feeding motor 130 (e.g., a PWM signal value between the PWM signal value at the detection of the stoppage of the paper-feeding motor 130 and the PWM signal value at the detection of the reverse movement of the paper-feeding motor 130). The method of operation of FIG. 6 may be used in place of the method of FIG. 5, or may be used in conjunction with the method of FIG. 5 to determine the value to which the PWM signal is respectively reduced and maintained in Operations S208 and S209 of FIG. 5 (corresponding to the PWM signal maintained in Operation S313 of FIG. 6). As desired, the method of FIG. 6 may be used for each type of printing medium available, and may be used on a periodic basis to account for changes in frictional forces in the operation of the image forming apparatus.

The image forming apparatus described above variably outputs the PWM signal until the paper reaches the target position, accelerates printing medium-feeding motor, and decelerates the printing medium-feeding motor in multi-stages. If the paper reaches the target position, the image forming apparatus decreases the PWM signal value to a predetermined value, maintains a current level, and stops the printing medium-feeding motor without reversely rotating the printing medium-feeding motor, or stops the printing medium-feeding motor instantaneously after it rotates in a reverse direction. As a result, the image forming apparatus can continue the feeding operation until the paper reaches the target position and avoid unacceptable errors due to a large reverse rotation of the paper-feeding motor, such that the paper can be acceptably transferred to the target position.

Although embodiments of the present general inventive concept have been shown and described, it would be appreciated by those skilled in the art that changes may be made in these embodiments without departing from the principles and spirit of the general inventive concept, the scope of which is defined in the claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus which includes a printing medium-feeding motor to drive a feeding unit capable of feeding a printing medium, comprising:

a velocity sensor to measure a rotation amount of the motor;

a Pulse Width Modulated (PWM) driver to generate a PWM signal to drive the motor; and a controller to detect a current position of the printing medium on the basis of the rotation amount of the motor, the controller to control the PWM driver such that the PWM driver outputs a first PWM signal value to accelerate the motor to a first velocity, a second PWM signal value to maintain the motor at the first velocity, a third PWM signal value to decelerate the motor to a second velocity, a fourth PWM signal value to maintain the motor at the second velocity, and a fifth PWM signal value to decelerate the motor such that the motor stops when the printing medium is disposed at a target position, the fifth PWM signal value being a positive value that creates an electromotive force in the printing medium-feeding motor that is less than a kinetic frictional force resisting against the printing medium-feeding motor, after the printing medium reaches the target position, so that the printing medium-feeding motor stops rotation, and the controller maintains the lowered PWM signal value.

2. The image forming apparatus according to claim 1, wherein the fifth PWM signal value is a function of a previously determined PWM signal value obtained upon detecting the rotation of a printing medium-feeding motor in a reverse direction.

3. The image forming apparatus according to claim 1, wherein:

the controller re-detects a current position of the printing medium while gradually lowering the PWM signal value by a predetermined ratio, compares the re-detected current position of the printing medium with the target position, and determines whether the printing medium-feeding motor rotates in the reverse direction; and if the reverse rotation of the printing medium-feeding motor is determined, the controller stops lowering the PWM signal value, raises the PWM signal value by a predetermined ratio, and maintains the raised PWM signal value.

4. An image forming apparatus comprising:

a motor to move a printing medium along a transfer path to a target position, so that an image is formed on the printing medium in the target position; and a controller to generate a Pulse Width Modulated (PWM) signal output to the motor, and to vary the value of the PWM signal according to a position of the printing medium with respect to the target position, such that the motor accelerates to a first velocity during a first interval, maintains the first velocity during a second interval, decelerates to a second velocity during a third interval, maintains the second velocity during a fourth interval, and decelerates during a fifth interval such that the motor stops when the printing medium is disposed at the target position, wherein a value of the PWM signal output during the sixth interval is a positive value sufficient to maintain a stop position of the motor against a kinetic force thereof and prevent the motor from rotating in a reverse direction, when the printing medium is in the target position.

5. The image forming apparatus of claim 4, further comprising a sensor to detect a position of the printing medium and the target position, wherein the controller varies the value of the PWM signal, according to the detected position.

6. The image forming apparatus of claim 4, further comprising a sensor to detect an amount of rotation of the motor, wherein the controller varies the value of the PWM signal, according to the detected amount of rotation.

7. The image forming apparatus of claim 4, further comprising a sensor to detect a signal representing that the printing medium is at the target position, wherein the controller varies the value of the PWM signal, according to the detected signal.

8. The image forming apparatus of claim 4, wherein the PWM signal comprises a first PWM signal value to accelerate the motor during the first interval, a second PWM signal value to maintain the first velocity, a third PWM signal value to decelerate the motor during the third interval, a fourth PWM signal value to maintain the second velocity, and a fifth PWM signal value to decelerate the motor during the fifth interval, according to a distance between the printing medium and the target position.

9. The image forming apparatus of claim 8, wherein during the fifth interval, the motor decelerates at a lower rate than during the third interval.

10. The image forming apparatus of claim 8, wherein the PWM signal values are an average value of PWM signals supplied to the motor during the respective intervals.

11. The image forming apparatus of claim 4, wherein:

the motor rotates in a forward direction according to the PWM signal value to feed the printing medium toward the target position;

a force to rotate the motor in a reverse direction is generated when the PWM signal is not supplied to the motor; and a PWM signal value corresponding to the force is output after the fifth interval.

12. The image forming apparatus of claim 4, wherein when an image forming operation to form the image on the printing medium is completed a zero PWM signal value is output.

* * * * *